US005627629A

United States Patent [19]

Takahashi et al.

[11] Patent Number: 5,627,629

[45] Date of Patent: May 6, 1997

[54] IMAGE FORMING APPARATUS FOR FORMING AN IMAGE ON AN IMAGE RECEIVING MEMBER BY MULTIPLE IMAGE TRANSFER

[75] Inventors: Masashi Takahashi; Toshihiro Kasai, both of Yokohama; Minoru Yoshida, Tokyo, all of Japan

[73] Assignee: Kabushiki Kaisha Toshiba, Kawasaki, Japan

[21] Appl. No.: 526,089

[22] Filed: Sep. 11, 1995

[30] Foreign Application Priority Data

Oct. 6, 1994 [JP] Japan ..... 6-242997

[51] Int. Cl.[6] ..... G03G 15/01

[52] U.S. Cl. ..... 399/231; 430/42; 430/45

[58] Field of Search ..... 355/245, 271, 355/272, 273, 274, 326 R, 327, 219; 430/45, 47, 42; 118/645

[56] References Cited

U.S. PATENT DOCUMENTS 4,093,457 6/1978 Hauser et al. ..... 430/47
4,927,724 5/1990 Yamamoto et al. ..... 430/45
5,363,178 11/1994 Matsumoto ..... 355/273
5,469,248 11/1995 Fujiwara et al. ..... 355/326 R

FOREIGN PATENT DOCUMENTS 1-32981[B] 7/1989 Japan .
4-30023[B] 5/1992 Japan .
5-313458 11/1993 Japan ..... 355/273

*Primary Examiner*—Joan H. Pendegrass
*Attorney, Agent, or Firm*—Foley & Lardner

[57] ABSTRACT

An image forming apparatus includes at least two developing units containing two types of developing agents of different colors. This image forming apparatus is improved in the following points. i) The triboelectric charging amounts of the toner of the developing agents are reduced in the order of transfer. ii) The volume resistivities of the developing agents are reduced in the order of transfer. iii) The charging potentials of image carriers when electrostatic latent images corresponding to individual developing agents are formed are reduced in the order of transfer.

15 Claims, 5 Drawing Sheets

IMAGE FORMING APPARATUS FOR FORMING AN IMAGE ON AN IMAGE RECEIVING MEMBER BY MULTIPLE IMAGE TRANSFER

BACKGROUND OF THE INVENTION

1. Field of the Invention

The present invention relates to an image forming apparatus, such as an electrophotographic color copying machine or a color printer, which forms an image by sequentially multi-transferring developing agent images developed on image carriers while conveying a transfer medium by using a semiconductive transfer belt.

2. Description of the Related Art

As one conventional full-coller image forming method, there is a method in that absolute value of the triboelectric charging amount of the second color toner in the second developing unit is controlled larger than that of the first color toner in the first developing unit, such method is shown in such as Jpn. Pat. Appln. KOKAI Publication No. 1-32981.

In this method, a transferring efficiency may be improved, however, this method has a problem that toners are reverse charged easily so as to cause reverse transfer to a photoreceptor.

A multi-transfer system has also the other problem that when a resin sheet, e.g., an OHP (OverHead Projector) sheet, is used as a transfer medium particularly in a high-temperature, high-humidity environment, toner once transferred to the OHP sheet is reverse-transferred to a photoreceptor body in the succeeding transfer unit. The cause of this is considered that an OHP sheet is charged in the preceding transfer unit, and, when this OHP sheet is separated from the photoreceptor body, peel discharge occurs to reversely charge the transferred toner.

SUMMARY OF THE INVENTION

The present invention has been made in consideration of the above situation and has as its object to provide an image forming apparatus which can use a wide variety of transfer media since no reverse transfer occurs even if not only paper but an OHP sheet is used as a transfer medium, which causes no positional deviation, which can perform transfer at low voltages, and which suppresses generation of harmful ozone.

According to the first aspect of the present invention, there is provided an image forming apparatus comprising first developing agent image forming means for forming a first developing agent image on an image carrier by using a first developing agent having a frictional charging amount whose absolute value is a first value, second developing agent image forming means for forming a second developing agent image on the image carrier by using a second developing agent having a frictional charging about whose absolute value is a second value, the second value being lower than the first value, transfer means for electrostatically transferring the first developing agent image on a transfer medium, and for transferring the second developing agent image on the transfer medium on which the first developing agent has been transferred.

According to the second aspect of the present invention, there is provided an image forming apparatus comprising first developing agent image forming means for forming a first developing agent image on an image carrier by using a first developing agent having a volume resistance whose absolute value is a first value, second developing agent image forming means for forming a second developing agent image on the image carrier by using a second developing agent having a volume resistance whose absolute value is a second value, the second value being lower than the first value, and transfer means for electrostatically transferring the first developing agent image on a transfer medium, and for transferring the second developing agent image on the transfer medium on which the first developing agent image is transferred.

According to the third aspect of the present invention, there is provided an image forming apparatus comprising first charging means for charging an image carrier such that the image carrier has a surface potential whose absolute value is a first value, first exposing means for exposing on the charged image carrier charged by the first charging means for forming a first electrostatic latent image on the image carrier, second charging means for charging the image carrier such that the image carrier has a surface potential whose absolute value is a second value, the second value being lower than the first value, second exposing means for exposing on the image carrier charged by the second charging means for forming a second electrostatic latent image on the image carrier, the second value being lower than the first value, first developing agent image forming means for developing the first electrostatic latent image, and for forming a first developing agent image, second developing agent image forming means for developing the second electrostatic latent image and for forming a second developing agent image, and transfer means for electrostatically transferring the first and second developing agent images on a transfer medium.

According to the present invention, there is provided an image forming apparatus which can use a wide variety of transfer media since no reverse transfer occurs even if not only paper but an OHP sheet is used as a transfer medium, which causes no positional deviation, which can perform transfer at low voltages, and which suppresses generation of harmful ozone. With this image forming apparatus, high-quality transferred images can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The present invention is constituted by the first to third aspects each of which is an image forming apparatus including at least two developing devices containing two different developing agents. Each image forming apparatus has the following improvements:

(1) The triboelectric charging amounts of toners of the developing agents are reduced in the order of transfer.

(2) The volume resistivities of the developing agents are reduced in the order of transfer.

(3) The charging potentials of image carriers when electrostatic latent images corresponding to individual developing agents are formed are reduced in the order of transfer.

In the apparatus according to the first aspect of the present invention which corresponds to the improvement i) and the apparatus according to the second aspect which corresponds to the improvement ii), the former the stage the larger the number of times the toner is influenced by the transfer electric field. Therefore, the improvements are done by increasing the charging amount or the resistivity of the toner. In the apparatus according to the third aspect which corresponds to the improvement iii), the influence on the toner is reduced by decreasing the transfer electric field following the order of the transfer stages.

These image forming apparatuses can well perform multi-transfer even for OHP sheets, as well as paper, in a high-humidity environment.

The present invention will be described in detail below with reference to the accompanying drawings.

The image forming apparatus according to the first aspect of the present invention will be described.

Figure 1:
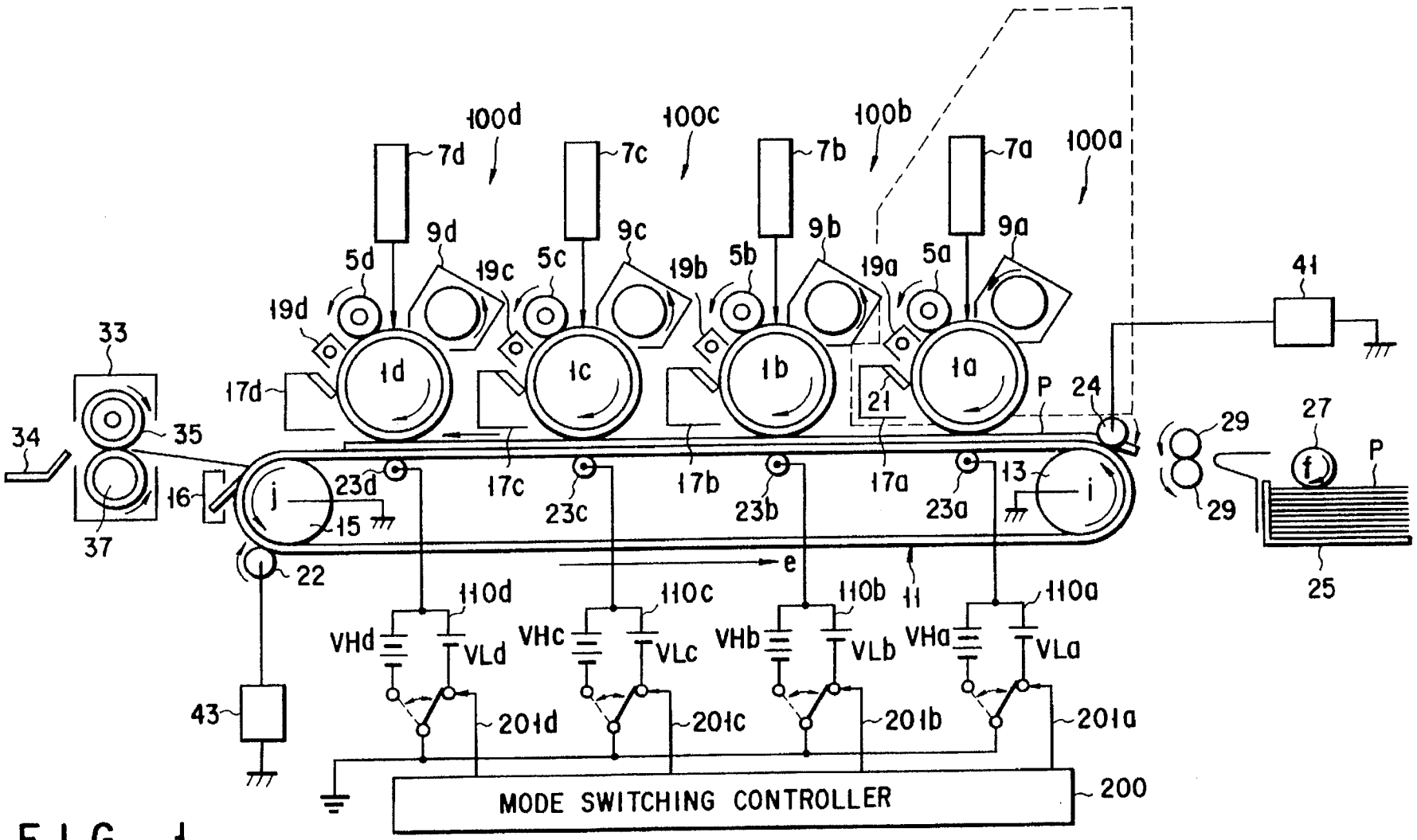
FIG. 1 is a schematic view of the first embodiment of the multi-transfer image forming apparatus according to the present invention.

FIG. 1 is a schematic view showing one embodiment of the color image forming apparatus according to the present invention.

Referring to FIG. 1, a photoreceptor drum la as an image carrier is a cylindrical, laminated-type organic photoreceptor body 40 mm in diameter and 266 mm in length. This photoreceptor drum 1*a* is so provided as to be rotatable in the direction indicated by an arrow.

Around the photoreceptor drum 1*a* the following devices are disposed along the rotating direction. A charging roller 5*a* constituted by a conductive rubber roller for evenly charging the photoreceptor drum 1*a* is provided in contact with the surface of the drum 1*a*. An exposure device 7*a* for forming an electrostatic latent image by exposing the charged photoreceptor drum 1*a* is disposed downstream of the charging roller 5*a*. A developing device 9*a* which contains a developing agent and develops the electrostatic latent image formed by the exposure device 7*a* with the developing agent is disposed downstream of the exposure device 7*a*. A conveying means 11 for conveying paper P as a transfer medium to the photoreceptor drum 1*a* is provided downstream of the developing device 9*a*. This conveying means 11 will be described later.

On the downstream side of the contact position between the photoreceptor drum 1*a* and the paper P, a blade cleaning device 17*a* and a charge removal lamp 19*a* are disposed. The blade cleaning device 17*a* scrapes off the developing agent remaining on the photoreceptor drum 1*a* after the transfer of the developing agent by using a blade 21. The charge removal lamp 19*a* is a tungsten lamp which optically removes the charge on the surface of the photoreceptor drum 1*a* after the transfer. One image formation cycle is completed by the charge removal by this charge removal lamp 19*a*. To successively perform image formation, the photoreceptor drum 1*a* which is uncharged is again charged by the charging roller 5*a*.

The conveying means 11 has a width nearly equal to the drum width of the photoreceptor drum 1*a*. As illustrated in FIG. 1, this conveying means 11 takes the form of an annular belt, and a tension roller 13 and a driving roller 15 are provided in the upstream and downstream annular portions, respectively, of the conveying means 11. The conveying means 11 is in contact with the tension roller 13 and the driving roller 15 so as to move along the outer circumferential surfaces of the rollers 13 and 15 in these annular portions. Note that the distance from the tension roller 13 to the driving roller 15 is about 300 mm. As in FIG. 1, the tension roller 13 and the driving roller 15 are so provided as to be rotatable in the directions of arrows i and j, respectively. With rotation of the driving roller 15 the conveying means 11 is annularly fed in the direction of an arrow e. The conveying speed is controlled to be equal to the rotating speed of the photoreceptor drum.

The belt herein used as the conveying means is required to have two functions, i.e., the function of conveying the transfer medium, and the function of transferring the developing agent. The belt, however, is simply referred to as a transfer belt in this description. This transfer belt consists of 25 parts by weight of conductive carbon particles and 75 parts by weight of thermosetting polyimide in which the conductive carbon particles are mixed. These materials are injected into a molding die and molded into a seamless, annular belt 270 mm in width and 80 mm in diameter by an imidization reaction. The film thickness of the belt is 100 μm.

The theoretical value of the electrical resistance in the direction of thickness per unit area of the contact nip area between the belt and a power supply roller 23 is $10^{11}$ Ω.cm$^2$. Since the thickness of the belt is 100 μm, the volume resistivity of the belt is $10^{13}$ Ω.cm. The volume resistivity is preferably controlled between $10^5$ and $10^{13}$ Ω.cm$^2$. The electrical resistance was measured by sandwiching the belt between stainless steel electrodes 1 kg in weight, applying a voltage of 500 V, and measuring the current flowing through the counter electrode having an area of 7.1 cm$^2$. The measurement was done at room temperature and normal humidity.

Other usable examples of the belt material are resins such as polycarbonate, polyethyleneterephthalate, polytetrafluoroethylene (Teflon), and polyvinylidene fluoride (PVDF), and various synthetic polymer alloys.

As shown in FIG. 1, a paper feed cassette 25 storing sheets of paper P is provided near the conveying means 11. This paper feed cassette 25 has a pickup roller 27 which is rotatable in the direction of an arrow f to pick up the sheets of paper P one by one. A registration roller pair 29 consisting of upper and lower rollers is provided before the conveying means 11 to be rotatable in the conveying direction of the paper P picked up by the pickup roller 27. The registration roller pair 29 feeds the paper P thus conveyed timely so that the leading end of the developing agent image formed on the photoreceptor drum 1*a* comes to the leading end of the paper P.

The paper P thus supplied is conveyed to an attraction roller 24 which contacts the conveying means 11 at the position at which the attraction roller 24 opposes the tension roller 13 on the other side of the conveying means 11. This attraction roller is an SUS metal roller 6 mm in diameter. The roller can also be a conductive rubber roller made of, e.g., carbon-dispersed urethane rubber. A conductive brush or a corona charger also is usable.

A power supply 41 supplies power to the attraction roller 24. The applied voltage is −1.5 kV. The higher the applied voltage for attraction, the larger the amount of electric charge given to the belt and hence the attraction force. When the limit of the withstand voltage of the belt material is taken into account, however, the applied voltage is at most about 3 kV.

The attraction roller 24 rotates in accordance with the conveying direction of the belt or the paper P. The attraction bias is applied at the same time the paper P is conveyed to the attraction roller section. Consequently, the surface of the paper P is negatively charged, and the opposite side of the belt (on the side of the tension roller 13) is positively charged. The electrostatic force resulting from this charge attracts the paper P.

As described above, a first process unit 100*a* is constituted by the photoreceptor drum 1*a*, the charging roller 5*a*, the exposure device 7*a*, the developing device 9*a*, the blade cleaning device 17*a*, and the charge removal lamp 19*a*.

On the conveying means 11 between the tension roller 13 and the driving roller 15, the first process unit 100*a* described above and second, third, and fourth process units 100*b*, 100*c*, and 100*d* are arranged along the conveying direction (these process units 100*a*, 100*b*, 100*c*, and 100*d* will be generically termed process units 100 hereinafter). The process units 100*b*, 100*c*, and 100*d* have the same arrangement as that of the process unit 100*a*. That is, photoreceptor drums 1*b*, 1*c*, and 1*d* (the photoreceptor drums 1*a*, 1*c*, 1*b*, and 1*d* will be generically termed photoreceptor drums 1 hereinafter) are provided in nearly the centers of the respective process units 100. Around the photoreceptor drums 1, charging rollers 5*b*, 5*c*, and 5*d* (the charging rollers 5*a*, 5*b*, 5*c*, and 5*d* will be generically termed charging rollers 5 hereinafter) are disposed. As in the process unit 100*a*, the devices disposed downstream of the charging rollers 5 are: exposure devices 7*b*, 7*c*, and 7*d* (the exposure devices 7*a*, 7*b*, 7*c*, and 7*d* will be generically termed exposure devices 7 hereinafter); blade cleaning devices 17*b*, 17*c*, and 17*d* (the blade cleaning devices 17*a*, 17*b*, 17*c*, and 17*d* will be generically termed blade cleaning devices 17 hereinafter); and charge removal lamps 19*b*, 19*c*, and 19*d* (the charge removal lamps 19*a*, 19*b*, 19*c*, and 19*d* will be generically termed charge removal lamps 19 hereinafter). The process units 100 are different from each other only in the type of developing agent contained in each developing device. That is, the process units 100*a*, 100*b*, 100*c*, and 100*d* contain yellow, magenta, cyan, and black developing agents, respectively.

In outputting a color image, the paper P conveyed by the conveying means 11 is sequentially made contact with the photoreceptor drums 1. At the contact positions between the paper P and the individual photoreceptor drums 1, power supply rollers 23*a*, 23*b*, 23*c*, and 23*d* (to be generically termed power supply rollers 23 hereinafter) as transfer means are provided in a one-to-one correspondence with the photoreceptor drums 1. At the contact position between the corresponding photoreceptor drum 1 and the conveying means 11, each power supply roller 23 is brought into contact with the back side of the conveying means 11 and opposes the photoreceptor drum 1 via the conveying means 11.

As illustrated in FIG. 1, the power supply rollers 23*a*, 23*b*, 23*c*, and 23*d* are connected to bias power supplies 110*a*, 110*b*, 110*c*, and 110*d*, respectively, as voltage applying means, and are rotated in accordance with the movement of the conveying means 11. The bias power supplies 110*a* to 110*d* are connected to a paper mode/OHP mode switching controller 200. When the transfer medium is paper, select switches are closed to power supplies VLa, VLb, VLc, and VLd upon receiving mode switch signals 201*a*, 201*b*, 201*c*, and 201*d*, respectively, from the mode switching controller 200. As a consequence, the power supply roller 23*a* applies a transfer voltage of 1200 V in the first transfer station of the first process unit 100*a* connected to the power supply VLa, the power supply roller 23*b* applies a transfer voltage of 1250 V in the second transfer station of the second process unit 100*b* connected to the power supply VLb, the power supply roller 23*c* applies a transfer voltage of 1300 V in the third transfer station of the third process unit 100*c* connected to the power supply VLc, and the power supply roller 23*d* applies a transfer voltage of 1400 V in the fourth transfer station of the fourth process unit 100*d* connected to the power supply VLd. When the transfer medium is an OHP sheet, on the other hand, transfer biases of 1600 V, 1700 V, 2000 V, and 2600 V are applied in the first, second, third, and fourth transfer stations, respectively. The paper mode and the OHP mode can be switched by selection of paper P on the printer.

The image formation process of the image forming apparatus with the above arrangement will be described below. The rotary photoreceptor drum 1 of each of the four process units described above is first evenly charged to approximately −500 V by the contact charging roller 5 which is applied with an AC-superposed DC bias.

The photoreceptor drum 1 thus evenly charged by the charging roller is illuminated with light emitted from a solid-state scanning head (the exposure device 7) which performs exposure by using a fluorescent material, and as a result an electrostatic latent image is formed. This electrostatic latent image is developed by the developing device 9 by using a developing agent of a predetermined color which is previously well charged.

Meanwhile, the paper P is picked up from the paper feed cassette 25 by the pickup roller 27 and fed to the registration roller pair 29. In order that the leading end of the developing agent image comes to the leading end of the paper P, the registration roller pair 29 sends the paper P onto the conveying means 11 timely in accordance with the rotation of the photoreceptor drum 1.

When the paper P is conveyed to the transfer position of the first transfer station, the power supply roller 23 applies the bias voltage to the conveying means 11. Upon application of the bias voltage, a transfer electric field is formed between the photoreceptor drum 1 and the conveying means 11. Accordingly, the developing agent image on the photoreceptor drum 1*a* is transferred onto the paper P, and the paper P carrying this developing agent image is conveyed to the photoreceptor drum 1*b*. The developing agent image formed on the photoreceptor drum 1*b* is transferred onto the developing agent image previously transferred. The paper P is further transferred to the photoreceptor drum 1*c* and then to the photoreceptor drum 1*d*, and the developing agent images of the respective colors are similarly transferred. Since the bias voltage is gradually increased following the order of the transfer stages, decrease of transferring efficiency may be prevented at the order of the transfer stages.

The paper P which carries the image formed by the multi-transfer as above is supplied from the conveying means 11 to a fixing device 33. The fixing device 33 has a heat roller 35 and a pressure roller 37. The paper P is passed between the heat roller and the pressure roller such that the image comes in contact with the heat roller. The result is that the image is fixed on the paper P.

After the paper P is separated from the conveying means, the belt surface is cleaned by a blade cleaning device 16.

An embodiment of the image forming apparatus according to the first aspect of the present invention will be described below. Toners described in Examples 1 and 2 below can be used in the image forming apparatus according to the first aspect of the present invention.

EXAMPLE 1

Toner manufacturing method

A styrene-acryl copolymer and other additives such as a pigment and a charge control agent to be mixed in the copolymer were melted and kneaded to have the compositions shown in Table 1 (to be presented later). Each kneaded material was cooled, solidified, and ground to be 10 μm or smaller by a grinding step using a jet mill. Each resultant powder was classified to yield toner having a predetermined particle size, e.g., an average particle size of 7 to 8 μm.

The charging amount (triboelectric charging amount) of each toner was measured by a blow-off method by attracting toner particles and calculating from the charging amount and the weight of the particles. The measurements were done at a pressure of 1 kg/cm$^2$ for a blow time of 10 sec, by using an attraction charging amount measurement device available from TOSHIBA CHEMICAL CORP.

The charging amounts and the compositions of the toners are summarized in Table 1. The data of toners as comparative examples will also be presented in the following Table 3. The toners of the comparative examples are conventional ones whose toner charging amounts have no definite relation. On the other hand, in the case of the toners of the present invention the absolute value of the toner charging amount decreases following the order of the transfer stages; that is, the relation is 15>12>8>6. According to the first aspect of the present invention, it is preferable that triboelectric charging amounts $Q_n$ (μC/g) and $Q_{n+1}$ (μC/g) of the nth and (n+1)th developing process units meet a relation $|Q_n| \geqq 1.3|Q_{n+1}|$ where n is an integer, and in this case it is preferable that $|Q_1| \geqq 1.3|Q_2|$, $|Q2| \geqq 1.3|Q3|$, and $|Q3| \geqq 1.3|Q4|$. In Example 1, 15 (μC/g)≧1.3×11 (μC/g), 11 (μC/g)≧1.3×8 (μC/g), and 8 (μC/g)≧1.3×6 (μC/g), so this relation is satisfied.

If the coefficient in the relation exceeds 1.3, difference among charging amounts of each stations are too large, so suitable transfer cannot be performed, and, if the coefficient is larger than 1 and smaller than 1.3, toner is reverse charged since toners are subjected to high electric field repeatedly, which electric field increases following the order of the transfer stages so as to cause reverse transfer.

By the use of the image forming apparatus meeting the relation of the toner charging amount of the present invention, in multi-transfer to OHP sheets it was possible to well perform the transfer without causing reverse transfer.

The charging amount of the toner was controlled by changing the addition amount and the material of the charge control agent (CCA) and the material of the pigment.

The toner charging amount can also be controlled by changing parameters such as the binder resin material, the dispersing conditions, or the composition ratio. For example, the toner charge amount can be controlled by altering the amounts of monomers in the synthesis of the resin.

The styrene-acryl copolymer herein used was synthesized in the following fashion by using a solution polymerization method in which monomers were dissolved in a solvent and a polymerization reaction was performed by adding a polymerization initiator.

First, a flask containing isopropyl alcohol was heated to 75° C., and a mixture of 1275 g of styrene, 200 g of butylacrylate, 26 g of methacrylic acid, and 25 g of azobisisoproponitrile, as a polymerization initiator, was dropped into the flask over four hours, thereby performing polymerization under stirring. After the dropping, the temperature was immediately increased to 80° C. and kept at that value for 10 hours, allowing the polymerization to continue. When the polymerization reaction was completed, the reaction product was heated and dried under reduced pressure to yield a solid copolymer resin. A styrene-based monomer can be chosen from styrene and its derivatives, e.g., alkylstyrene such as methylstyrene, dimethylstyrene, trimethylstyrene, ethylstyrene, diethylstyrene, triethylstyrene, propylstyrene, butylstyrene, hexylstyrene, heptylstyrene, and octylstyrene; halogenated styrene such as phlorostyrene, chlorostyrene, bromostyrene, dibromostyrene, and iodostyrene; and nitrostyrene, acetylstyrene, and methoxystyrene.

An acrylic monomer as the resistance control monomer can be selected from monocarboxylic acid esters such as methyl methacrylate, ethyl methacrylate, methyl acrylate, ethyl acrylate, n-butyl acrylate, dodecyl acrylate, and 2-chloroethyl acrylate.

As the coloring agent, it is possible to use black toner coloring agents such as carbon black, iron oxide, ferrite, and aniline black. In addition to these coloring agents, organic or inorganic pigments or dyes of respective colors also can be used.

As the charge control agent, it is possible to use chlorinated polyolefin, chlorinated polyester, acid-group-excess polyester, a metal complex of a monoazo dye, and a metal salt of aliphatic acid.

Wax as a releasing agent and silica as a flowability imparting agent also were added.

TABLE 1

Compositions and triboelectric charging amounts of toners

| | Composition | wt % | Triboelectric charging amount |
|---|---|---|---|
| First station | Styrene-acryl copolymer | 75.6 | |
| | Pigment (coloring agent) | 18.3 | |
| | Wax | 3 | −15 μC/g |
| | CCA | 2.2 | |
| | Other additives | 0.9 | |
| Second Station | Styrene-acryl copolymer | 75.1 | |
| | Pigment (coloring agent) | 19.5 | |
| | Wax | 3 | −11 μC/g |

TABLE 1-continued

| | Compositions and triboelectric charging amounts of toners | | |
|---|---|---|---|
| | Composition | wt % | Triboelectric charging amount |
| | CCA | 1.6 | |
| | Other additives | 0.8 | |
| Third Station | Styrene-acryl copolymer | 77.7 | |
| | Pigment (coloring agent) | 17.5 | |
| | Wax | 3 | −8 μC/g |
| | CCA | 1.1 | |
| | Other additives | 0.7 | |
| Fourth Station | Styrene-acryl copolymer | 80.7 | |
| | Pigment (coloring agent) | 15.1 | |
| | Wax | 3 | −6 μC/g |
| | CCA | 0.5 | |
| | Other additives | 0.7 | |

Image formation was performed by applying the resultant toners to the apparatus shown in FIG. 1, with the result that good images free of transfer defects were obtained.

EXAMPLE 2

Other examples of the toners for use in the image forming apparatus according to the first aspect of the present invention were manufactured following the same procedures as in Example 1 except that the compositions were changed as shown in Table 2 below.

TABLE 2

| | Compositions and triboelectric charging amounts of toners | | |
|---|---|---|---|
| | Composition | wt % | Triboelectric charging amount |
| First Station | Styrene-acryl copolymer | 75.3 | |
| | Pigment (coloring agent) | 19.0 | |
| | Wax | 3 | −11.5 μC/g |
| | CCA | 1.8 | |
| | Other additives | 0.9 | |
| Second Station | Styrene-acryl copolymer | 76.5 | |
| | Pigment (coloring agent) | 18.5 | |
| | Wax | 3 | −8.5 μC/g |
| | CCA | 1.2 | |
| | Other additives | 0.8 | |
| Third Station | Styrene-acryl copolymer | 78.0 | |
| | Pigment (coloring agent) | 17.5 | |
| | Wax | 3 | −6.3 μC/g |
| | CCA | 0.8 | |
| | Other additives | 0.7 | |
| Fourth Station | Styrene-acryl copolymer | 80.0 | |
| | Pigment (coloring agent) | 16.0 | |
| | Wax | 3 | −4.7 μC/g |

TABLE 2-continued

| | Compositions and triboelectric charging amounts of toners | | |
|---|---|---|---|
| | Composition | wt % | Triboelectric charging amount |
| | CCA | 0.4 | |
| | Other additives | 0.6 | |

Image formation was performed by applying the resultant toners to the apparatus illustrated in FIG. 1. The result was that good images free of transfer defects were obtained.

Although the toners described above are changed negatively, toners can be charged positively may be used and perform good effect, similarly.

CONTROL 1

Toners were formed following the same procedures as in Example 1 except that the compositions listed in Table 3 below were used.

TABLE 3

| | Compositions and triboelectric charging amounts of toners | | |
|---|---|---|---|
| | Composition | wt % | Triboelectric charging amount |
| First Station | Styrene-acryl copolymer | 84 | |
| | Pigment (coloring agent) | 10 | −8.0 μC/g |
| | Other additives | 6 | |
| Second Station | Styrene-acryl copolymer | 86 | |
| | Pigment (Coloring agent) | 9 | −7.6 μC/g |
| | Other additives | 5 | |
| Third Station | Styrene-acryl copolymer | 87 | |
| | Pigment (coloring agent) | 9 | −7.3 μC/g |
| | Other additives | 4 | |
| Fourth Station | Styrene-acryl copolymer | 87 | |
| | Pigment (coloring agent) | 8 | −8.2 μC/g |
| | Other additives | 5 | |

Image formation was performed by using the resultant toners, and it was found that transfer defects occurred due to reverse transfer.

An embodiment of the image forming apparatus according to the second aspect of the present invention will be described below.

The image forming apparatus according to the second aspect of the present invention has the same arrangement as that of the image forming apparatus according to the first embodiment, except that the volume resistivity of the toner used is so adjusted that the former the stage the higher the volume resistivity.

This volume resistivity was controlled by changing the addition amount and the material of a charge control agent (CCA) and the material of a pigment as in the technique used in the first aspect of the present invention.

It is also possible to control the volume resistivity by changing parameters such as the resin material, the dispersing conditions, and the composition ratio. As an example, the volume resistivity can be controlled by altering the amounts of monomers in the synthesis of the resin.

The volume resistivity of the toner was measured at 25° C. and 55% RH by using a measurement jig. First, a toner powder was placed in a flange and hardened into the form of pellets by performing tapping several tens of times at a pressure of $1.5\times10^3$ kg/cm$^2$. The pellets were shaped into a plate 1.5 mm thick. The plate was sandwiched between electrodes of 11.3 cm$^2$ with a load of 1 kg, and a voltage of 5 V was applied between the electrodes. The value of the flowing current was read when the current value became stable, and the volume resistivity of the toner was calculated from the read current value.

Toners presented in Examples 3 and 4 below can be used in the image forming apparatus according to the second aspect of the present invention.

EXAMPLES 3 & 4, AND CONTROL 2

The compositions and the resistivities of toners according to the second aspect of the present invention are listed in Tables 4 and 5. The compositions and the resistivities of conventional toners as comparative examples are given in Table 6. The resistivity of each toner was controlled by adjusting the amount of an acrylic monomer and the addition amount of a pigment or a metal oxide and by changing the conditions of the manufacturing process.

TABLE 4

| | Compositions and volume resistivities of toner | | |
|---|---|---|---|
| | Composition | wt % | Volume resistivity |
| First Station | Styrene-acryl copolymer | 75.6 | |
| | Pigment (coloring agent) | 18 | |
| | Wax | 3 | $2.4\times10^{12}$ Ωcm |
| | CCA | 2 | |
| | Other additives | 0.5 | |
| Second Station | Styrene-acryl copolymer | 71.3 | |
| | Pigment (coloring agent) | 23 | |
| | Wax | 3 | $3.1\times10^{11}$ Ωcm |
| | CCA | 2 | |
| | Other additives | 0.7 | |
| Third Station | Styrene-acryl copolymer | 68.1 | |
| | Pigment (coloring agent) | 26 | |
| | Wax | 3 | $5.2\times10^{10}$ Ωcm |
| | CCA | 2 | |
| | Other additives | 0.9 | |
| Fourth Station | Styrene-acryl copolymer | 70.8 | |
| | Pigment (coloring agent) | 23 | |
| | Wax | 3 | $8.5\times10^{9}$ Ωcm |
| | CCA | 2 | |
| | Other additives | 1.5 | |

TABLE 5

| | Compositions and volume resistivities of toner | | |
|---|---|---|---|
| | Composition | wt % | Volume resistivity |
| First Station | Styrene-acryl copolymer | 78.0 | |
| | Pigment (coloring agent) | 16.8 | |
| | Wax | 3 | $1.6\times10^{14}$ Ωcm |
| | CCA | 2 | |
| | Other additives | 0.2 | |
| Second Station | Styrene-acryl copolymer | 75.5 | |
| | Pigment (coloring agent) | 19.1 | |
| | Wax | 3 | $2.9\times10^{13}$ Ωcm |
| | CCA | 2 | |
| | Other additives | 0.4 | |
| Third Station | Styrene-acryl copolymer | 74.4 | |
| | Pigment (coloring agent) | 20.0 | |
| | Wax | 3 | $4.1\times10^{13}$ Ωcm |
| | CCA | 2 | |
| | Other additives | 0.6 | |
| Fourth Station | Styrene-acryl copolymer | 70.0 | |
| | Pigment (coloring agent) | 24.2 | |
| | Wax | 3 | $7.6\times10^{11}$ Ωcm |
| | CCA | 2 | |
| | Other additives | 0.8 | |

TABLE 6

| | Compositions and volume resistivities of toner | | |
|---|---|---|---|
| | Composition | wt % | Volume resistivity |
| First Station | Styrene-acryl copolymer | 85 | |
| | Pigment (coloring agent) | 10 | $3.6\times10^{11}$ Ωcm |
| | Other additives | 5 | |
| Second Station | Styrene-acryl copolymer | 87 | |
| | Pigment (coloring agent) | 8 | $5.4\times10^{12}$ Ωcm |
| | Other additives | 5 | |
| Third Station | Styrene-acryl copolymer | 84 | |
| | Pigment (coloring agent) | 11 | $8.7\times10^{10}$ Ωcm |
| | Other additives | 5 | |
| Fourth Station | Styrene-acryl copolymer | 87 | |
| | Pigment (coloring agent) | 10 | $1.2\times10^{13}$ Ωcm |
| | Other additives | 3 | |

In the present invention, the volume resistivities of the toners were $2.4\times10^{12}>3.1\times10^{11}>5.2\times10^{10}>8.5\times10^{9}$. According to the second aspect of the present invention, it is preferable that volume resistivities $R_n$ (Ω.cm) and $R_{n+1}$ (Ω.cm) of developing agents used in the nth and (n+1)th developing units meet a relation $R_n \geqq 5R_{n+1}$, and in this case it is preferable that R1≧5R2, R2≧5R3, and R3≧5R4. In this example, $2.4\times10^{12}$ (Ω.cm)≧$5\times3.1\times10^{11}$ ( Ω.cm), $3.1\times10^{11}$ (Ω.cm)≧$5\times5.2\times10^{10}$ (Ω.cm), and $5.2\times10^{10}$ (Ω.cm) ≧$5\times8.5\times10^{9}$ (Ω.cm), so this relation is satisfied. If this coefficient is 5 or larger, difference among resistance of each stations are too large, thereby suitable transfer cannot be performed, and, if the coefficient is larger than 1 and smaller than 5, toners are reverse charged since toners are subjected to high electric field, repeatedly, which electricfield increases following the order of the transfer stations so as to cause reverse transfer.

As shown in Examples 4 and 5, when the volume resistivity of the toner used was larger in the stage in which transfer was done earlier, good images were obtained since no reverse transfer occurred in multi-transfer to OHP sheets.

In contrast, when the volume resistivities of the toners had no definite relation as in Control 2, transfer defects were caused by reverse transfer.

An embodiment of the image forming apparatus according to the third aspect of the present invention will be described below.

In the image forming apparatus according to the third aspect of the present invention, the charging potential of a photosensitive material can be controlled as explained in Example 6 below.

EXAMPLE 6

Figure 2:
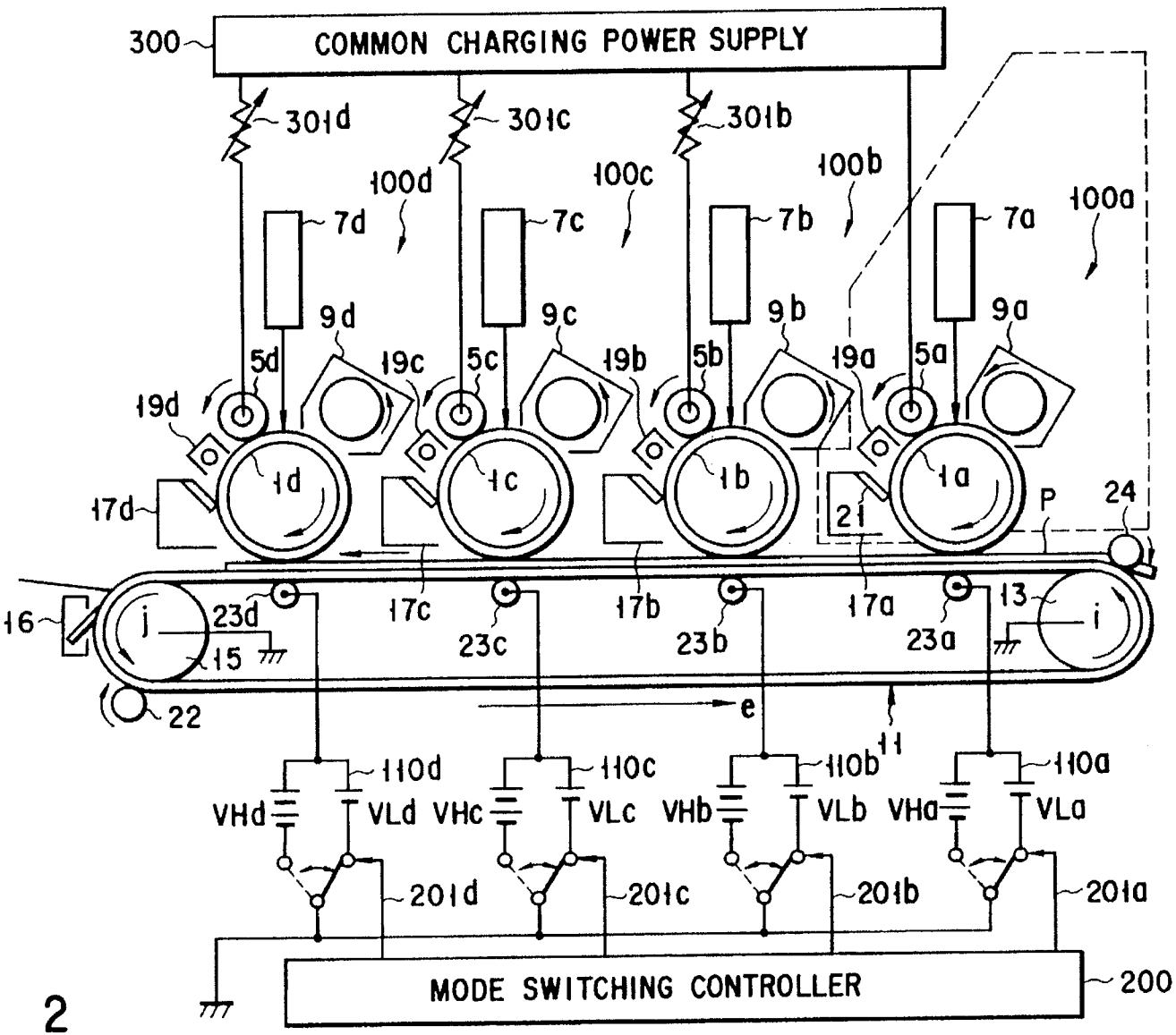
FIG. 2 is a schematic view of the second embodiment of the multi-transfer image forming apparatus according to the present invention.
Figure 3:
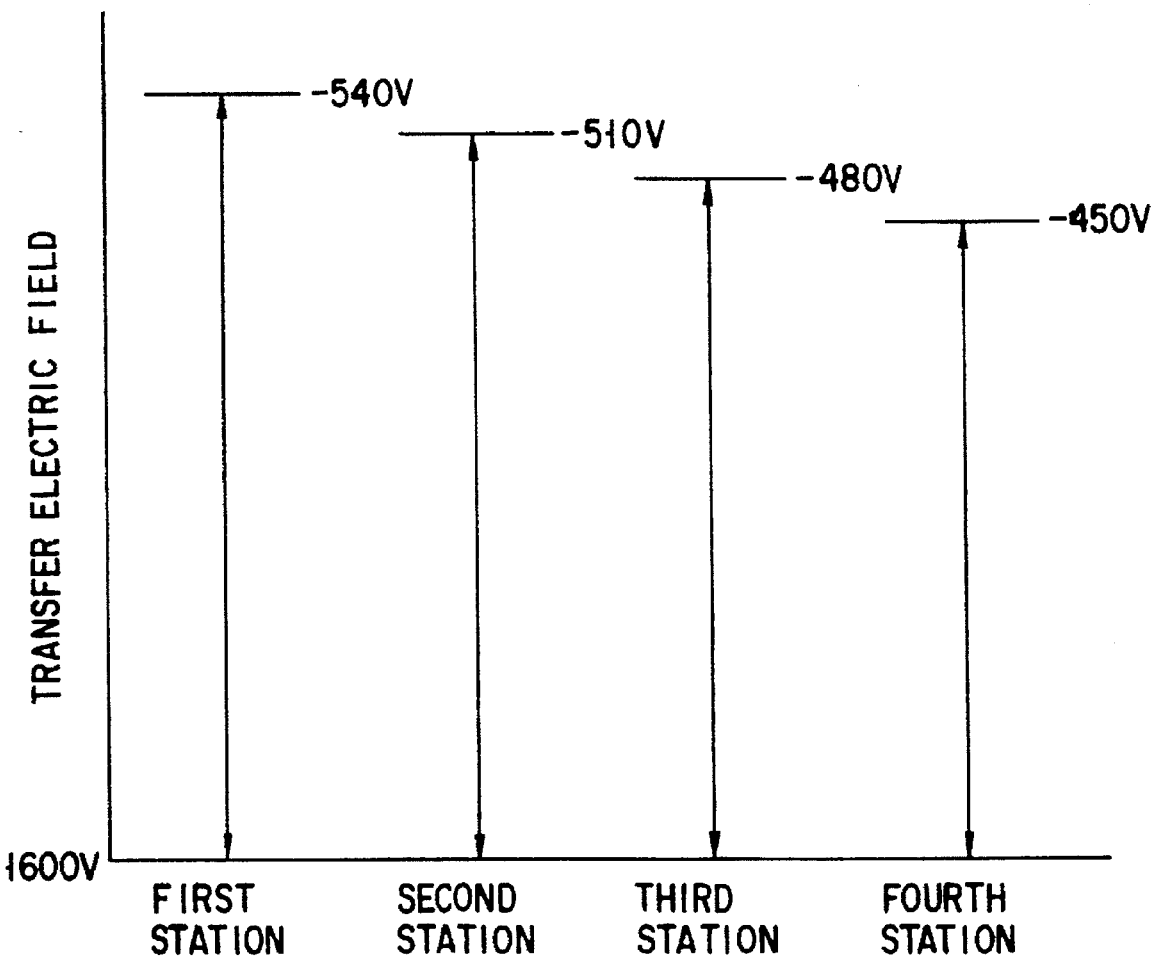
FIG. 3 is a graph showing change of transfer electrical field in the second embodiment of the multi-transfer image forming apparatus.

The arrangement of an image forming apparatus used in Example 6 is nearly the same as that in Example 1 except for the charging processing for a photoreceptor body. In this apparatus, the charging potentials for the photosensitive bodies in the first, second, third, and fourth stations were set at −540 V, −510 V, −480 V, and −450 V, respectively. FIG. 2 shows an embodiment of the image forming apparatus according to the third aspect of the present invention. As in FIG. 2, resistors 301*b*, 301*c*, and 301*d* were inserted between a common charging power supply 300 and charging rollers 5*b*, 5*c*, and 5*d* in the second, third, and fourth stations, respectively, thereby adjusting the respective applied voltages. When the charging potential of the photoreceptor body changes, the gradation characteristics of an image also change accordingly. However, the change of the gradation characteristics can be controlled by optimizing the exposure or the developing bias. In this example, the developing bias was optimized. At this example, bias voltages applying to power supply roller 23*a*, 23*b*, 23*c* and 23*d* are equal. Such voltage is equal to 1600 V. Change of transfer electrical field in each stations is shown in FIG. 3.

Also, when the charging potential was higher in the stage in which transfer was done earlier as in this example, good images were obtained in multi-transfer to OHP sheets without causing reverse transfer.

According to the third aspect of the present invention, it is preferable that a relation $1.1|V_{n+1}| \geqq |V_n|$ be satisfied where $V_n$ is the charging potential of an image carrier in the nth electrostatic latent image formation in the nth developing unit and $V_{n+1}$ is the charging potential of an image carrier in the (n+1)th electrostatic latent image formation in the (n+1) th developing unit. In this case it is most preferable that 1.1|V1|≧|V1|, 1.1|V3|≧|V2|, and 1.1|V4|≧|V3| be met. In this example, V1 is 650, V2 is 600, V3 is 550, and V4 is 500, so this relation is satisfied. If the coefficient is smaller than 1.1 improvement of reverse transfer cannot be found.

EXAMPLE 7

Reverse transfer often occurs in Monochromatic portions where toners should not be overlapped when multi-transfer is performed on OHP sheets. That is, after being transferred, monochromatic portions are influenced by charged photoreceptor neither exposed nor developed in the second and subsequent stations. Consequently, the potential of the photoreceptor body opposite to the OHP sheets is kept at the initial charging potential, and this increases the transfer electric field as compared with portions being exposed and developed. In the present invention, therefore, the photoreceptor body is optically charge-removed prior to performing transfer. Since this decreases the transfer electric field, the influence on the toner transferred in the preceding stage is also decreased.

Figure 4:
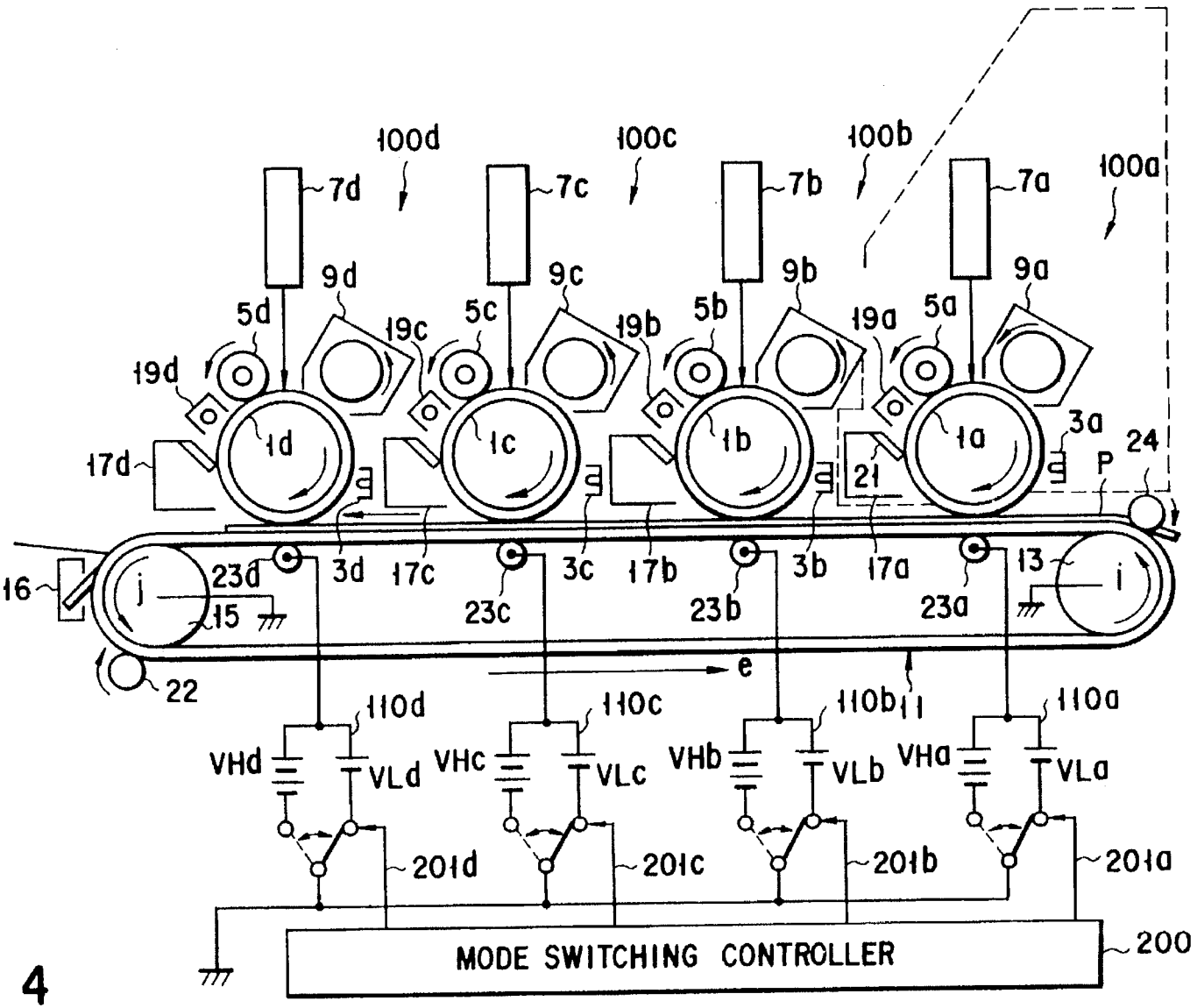
FIG. 4 is a schematic view of the third embodiment of the multi-transfer image forming apparatus according to the present invention.

FIG. 4 is a schematic view showing an apparatus further equipped with pretransfer charge removal units (3*a*, 3*b*, 3*c*, and 3*d*) as compared with the apparatus shown in FIG. 2.

In the apparatus in FIG. 4, in each process unit 100 an array of LED lamps, 3*a*, 3*b*, 3*c*, or 3*d*, was disposed between a developing device 9 and a transfer belt 11, and with this device the photoreceptor body was optically charge-removed. The result was that transfer free of reverse transfer was possible. The rest of the arrangement excluding the optical charge removal units 3*a*, 3*b*, 3*c*, and 3*d* is identical with that of Example 1.

In the present invention, in designing the image forming apparatus it is possible to apply various arrangements of apparatuses regularly used in the multi-transfer system, except for the improvements according to the first to third aspects described above.

As an example, a single common image carrier can be provided for a plurality of developing units, and different electrostatic latent images can be sequentially formed in accordance with the types of developing agents. Alternatively, a plurality of image carriers can be provided in a one-to-one correspondence with developing units. In this case one electrostatic latent image is formed on each carrier for each developing agent used.

Also, each of the image carrier and the transfer means can be a drum type or a belt type.

Figure 5:
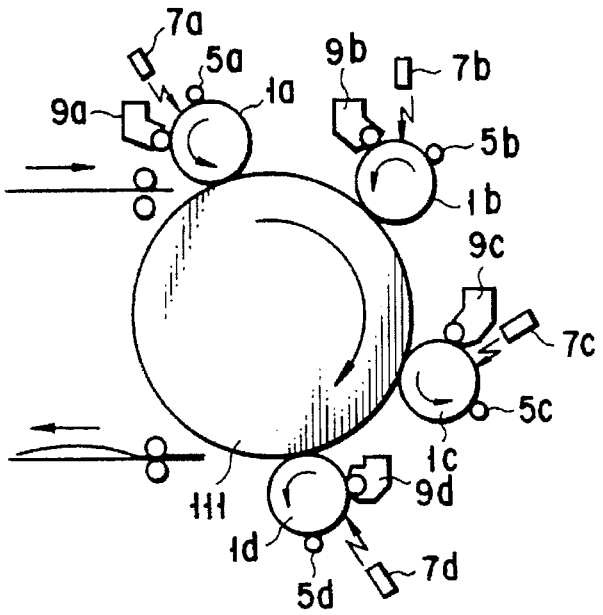
FIG. 5 is a schematic view of the fourth embodiment of the multi-transfer image forming apparatus according to the present invention.
Figure 6:
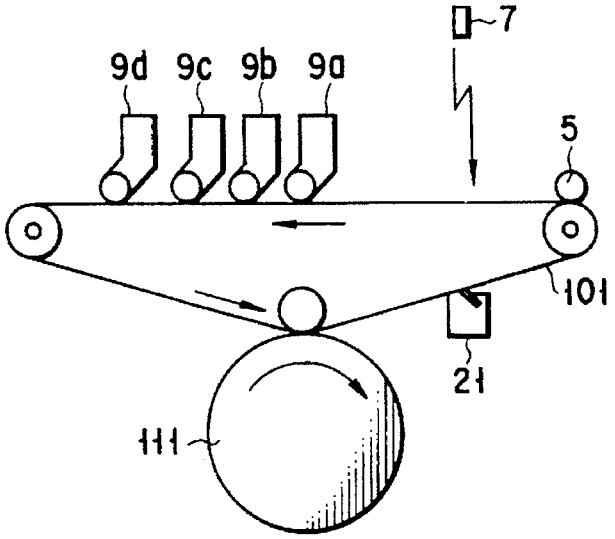
FIG. 6 is a schematic view of the fifth embodiment of the multi-transfer image forming apparatus according to the present invention.
Figure 7:
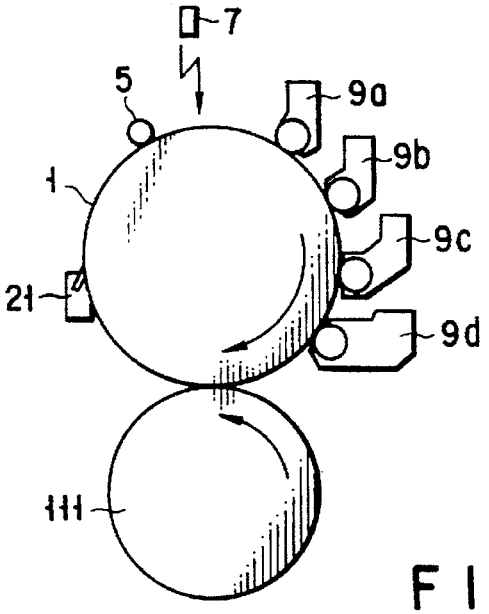
FIG. 7 is a schematic view of the sixth embodiment of the multi-transfer image forming apparatus according to the present invention.

Furthermore, it is preferable to provide an optical charge removal step for the image carrier between the development step and the transfer step. Arrangements of Other Image Forming Apparatuses FIGS. 5 to 7 show other embodiments of the image forming apparatus according to the present invention. As described above, in the multi-transfer system, FIG. 1, the combinations of the developing devices 9*a*, 9*b*, 9*c*, and 9*d* and the drum-like image carriers 1*a*, 1*b*, 1*c*, and 1*d* are arranged horizontally, and the belt-like transfer medium conveying means is in contact with them. However, the present invention is not limited to this system. In FIG. 5, combinations of developing devices 9*a*, 9*b*, 9*c*, and 9*d* and drum-like image carriers 1*a*, 1*b*, 1*c*, and 1*d* are brought into contact with a transfer drum 111. In FIG. 6, developing devices 9*a*, 9*b*, 9*c*, and 9*d* are made contact with a single belt-like image carrier 101. In FIG. 7, developing devices 9*a*, 9*b*, 9*c*, and 9*d* are made contact with a drum-like image carrier 1. The common feature of the processes of these apparatuses is that toner images of different colors formed on the image carrier (or carriers) are transferred a plurality of number of times.

Note that in FIGS. 1 to 7 the same reference numerals denote the same parts.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

first developing agent image forming means for forming a first developing agent image on an image carrier by using a first developing agent having a volume resistance whose absolute value is a first value;

second developing agent image forming means for forming a second developing agent image on the image carrier by using a second developing agent having a volume resistance whose absolute value is a second value, the second value being lower than the first value; and transfer means for electrostatically transferring the first developing agent image onto a transfer medium, and for transferring the second developing agent image onto the transfer medium onto which the first developing agent image is transferred.

2. An apparatus according to claim 1, wherein the first value is five or more times as high as the second value.

3. An image forming apparatus comprising:

first developing agent image forming means for forming a first developing agent image on a first image carrier by using a first developing agent having a volume resistance whose absolute value is a first value;

second developing agent image forming means for forming a second developing agent image on a second image carrier by using a second developing agent having a volume resistance whose absolute value is a second value, the second value being lower than the first value;

conveying means for conveying a transfer medium to the first and second image carriers, successively;

first transfer means for electrostatically transferring the first developing agent image onto the transfer medium; and second transfer means for electrostatically transferring the second developing agent image onto the transfer medium onto which the first developing agent has been transferred.

4. An apparatus according to claim 3, wherein the first value is five or more times as high as the second value.

5. An apparatus according to claim 3, wherein an amount of a charge applied to the transfer medium by the second transfer means is larger than an amount of a charge applied to the transfer medium by the first transfer means.

6. An apparatus according to claim 3, wherein the first transfer means comprises:

a first transfer roller opposed to the first image carrier via the conveying means; and first voltage applying means for applying a bias voltage of a first value to said first transfer roller, and the second transfer means comprises:

a second transfer roller opposed to the second image carrier via the conveying means; and second voltage applying means for applying a bias voltage of a second value to said second transfer roller, the bias voltage of the second value being higher than the bias voltage of the first value.

7. An apparatus according to claim 3, wherein the conveying means has a resistance of $10^5$ to $10^{13}$ Ω.cm.

8. An image forming method comprising the steps of:

forming a first developing agent image on an image carrier by using a first developing agent having a volume resistance whose absolute value is a first value;

forming a second developing agent image on the image carrier by using a second developing agent having a volume resistance whose absolute value is a second value, the second value being lower than the first value; and electrostatically transferring the first developing agent image onto the transfer medium, and transferring the second developing agent image onto the transfer medium onto which the first developing agent image has been transferred.

9. An image forming apparatus comprising:

first charging means for charging a first image carrier such that the first image carrier has a surface potential whose absolute value is a first value;

first exposing means for exposing on said first image carrier charged by said first charging means for forming a first electrostatic latent image on the first image carrier;

second charging means for charging a second image carrier such that the second image carrier has a surface potential whose absolute value is a second value, the second value being lower than the first value;

second exposing means for exposing on said second image carrier charged by said second charging means for forming a second electrostatic latent image on the second image carrier;

first developing agent image forming means for developing the first electrostatic latent image, and for forming a first developing agent image;

second developing agent image forming means for developing the second electrostatic latent image and for forming a second developing agent image;

conveying means for conveying a transfer medium to the first and second image carriers, successively;

first transfer means for electrostatically transferring the first developing agent image onto a transfer medium; and second transfer means for electrostatically transferring the second developing agent image onto the transfer medium onto which the first developing agent image has been transferred.

10. An apparatus according to claim 9, wherein the first value is 1.1 or more times as high as the second value.

11. An apparatus according to claim 9, wherein an amount of a charge applied to the transfer medium by the second transfer means is larger than an amount of a charge applied to the transfer medium by the first transfer means.

12. An apparatus according to claim 9, wherein the first transfer means comprises:

a first transfer roller opposed to the first image carrier via the conveying means; and first voltage applying means for applying a bias voltage of a first value to said first transfer roller, and the second transfer means comprises:

a second transfer roller opposed to the second image carrier via the conveying means; and second voltage applying means for applying a bias voltage of a second value to said second transfer roller, the bias voltage of the second value being higher than the bias voltage of the first value.

13. An apparatus according to claim 9, wherein the conveying means has a resistance of $10^5$ to $10^{13}$ Ω.cm.

14. An image forming method comprising:

a first charging step for charging an image carrier such that the image carrier has a surface potential whose absolute value is a first value;

a first exposing step for exposing on the image carrier charged by the first charging step to form a first electrostatic latent image;

a second charging step for charging the image carrier such that the image carrier has a surface potential whose absolute value is a second value, the second value being lower than the first value;

a second exposing step for exposing on the image carrier charged by the second charging step to form a second electrostatic latent image;

developing the first electrostatic latent image and forming a first developing agent image;

developing the second electrostatic latent image and forming a second developing agent image; and electrostatically transferring the first and second developing agent images onto a transfer medium.

15. An image forming method comprising:

a first charging step for charging an image carrier such that the image carrier has a surface potential whose absolute value is a first value;

a first exposing step for exposing the image carrier charged by the first charging step to form a first electrostatic latent image;

a first developing step for developing the first electrostatic latent image and forming a first developing agent image;

a first transferring step for transferring the first developing agent image onto a transfer medium;

a second charging step for charging the image carrier after transferring the first developing agent image such that the image carrier has a surface potential whose absolute value is a second value, the second value being lower than the first value;

a second exposing step for exposing the image carrier charged by the second charging step to form a second electrostatic latent image;

a second developing step for developing the second electrostatic latent image and forming a second developing agent image; and a second transferring step for transferring the second developing agent image onto the transfer medium having the first developing agent image thereon.

* * * * *